US006831254B2

(12) United States Patent
Barritt

(10) Patent No.: US 6,831,254 B2
(45) Date of Patent: Dec. 14, 2004

(54) AUTOMATIC COOK SEQUENCING SYSTEM FOR MULTIPLE OVENS WITH REFRIGERATION UNIT

(75) Inventor: William D. Barritt, Cleveland, TN (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 10/665,215

(22) Filed: Sep. 22, 2003

(65) Prior Publication Data

US 2004/0056015 A1 Mar. 25, 2004

Related U.S. Application Data

(63) Continuation-in-part of application No. 10/207,827, filed on Jul. 31, 2002, now Pat. No. 6,710,308.

(51) Int. Cl.[7] ..... F25B 29/00; A21B 1/40; F27D 19/00

(52) U.S. Cl. ..... 219/394; 219/413; 219/486; 219/492; 165/61; 165/62; 165/64; 62/159

(58) Field of Search ..... 219/394, 412–414, 219/483, 486, 490, 492; 62/159; 165/61–65, 267–269

(56) References Cited

U.S. PATENT DOCUMENTS 2,504,794 A 4/1950 Berman et al.
3,028,472 A 4/1962 Baird
4,156,454 A 5/1979 Skala
4,355,521 A * 10/1982 Tsai ..... 165/63
4,474,107 A 10/1984 Cothran
4,703,306 A 10/1987 Barritt
4,812,963 A 3/1989 Albrecht et al.
4,884,626 A 12/1989 Filipowski
4,914,277 A 4/1990 Guerin et al.
5,363,746 A 11/1994 Gordon
5,710,409 A 1/1998 Schwarzbacker et al.
6,497,276 B2 * 12/2002 Clark et al. ..... 165/62

FOREIGN PATENT DOCUMENTS

GB 2026685 2/1980

* cited by examiner

*Primary Examiner*—Joseph Pelham
(74) *Attorney, Agent, or Firm*—Diederiks & Whitelaw, PLC

(57) ABSTRACT

A system used to program and coordinate the cooking operations for two or more ovens such that the cooking operations are completed at the same time, independent of particular setting variations. In accordance with a preferred embodiment of the invention, a single controller is utilized to program each of the ovens, with the controller incorporating an auto sequencing feature which causes the different cooking operations to be automatically performed, while terminating at the same time. Preferably, the system enables a second cooking operation to be programmed and initiated after a first cooking operation, while still providing for the auto sequencing of the cooking operation. Furthermore, a system is provided to enable the refrigerating of food items in one or more of the ovens prior to initiating a respective cooking operation.

20 Claims, 4 Drawing Sheets

AUTOMATIC COOK SEQUENCING SYSTEM FOR MULTIPLE OVENS WITH REFRIGERATION UNIT

CROSS-REFERENCE TO RELATED APPLICATION

The present application represents a continuation-in-part of U.S. patent application Ser. No. 10/207,827 filed Jul. 31, 2002 U.S. Pat. No. 6,710,308.

BACKGROUND OF THE INVENTION

1. Field of the Invention

The present invention pertains to the art of cooking appliances and, more particularly, to a system for programming multiple ovens for different cooking operations, while enabling automatic sequencing of the cooking operations such that the operations can terminate simultaneously.

2. Discussion of the Prior Art

When preparing a meal, whether in a commercial or residential setting, it is typically necessary to plan in advance the sequence in which different food items will be cooked in an attempt to have all the components of the meal completed at the same time. In some environments, only a single oven is available such that it is impossible to have all of the desired components of the meal done at the same time. However, the facilities at essentially all commercial cooking establishments provide for multiple ovens. Even in a residential setting, dual wall ovens are fairly commonplace. In addition, slide-in ranges which incorporate multiple ovens are now advantageously available in the marketplace. In any event, there exists various scenarios wherein multiple oven cooking operations can be performed for a single overall meal.

Regardless of the availability of multiple cooking ovens, the timing in the completion of the meal depends upon individual(s) actually preparing the meal. For example, if the cook is to prepare a casserole and biscuits, with the casserole needing to be cooked at 350° F. for 60 minutes, and the biscuits at 475° F. for 12 minutes, it is necessary for the cook to timely preheat the ovens and place the biscuits for baking after the casserole has been cooking for 48 minutes. Taking into account all the remaining prep and other work which might be required in connection with the overall meal, it is not uncommon to miss the window of opportunity in timing the cooking of various components of a meal. Obviously, missing this window can have a negative effect on the success of the entire meal. Although some cooking appliances provide for the programming of a delayed cooking operation, this still requires the user to calculate the delayed cooking time between the ovens and then to program at least one oven to operate in a delay cook mode. Not only can this process be time consuming, but it leaves room for errors which could detriment the meal.

Based on the above, it would be beneficial to enable multiple cooking cavities to be programmed for separate cooking operations through a system which provides for an automatic sequencing of the cooking operations. With such an arrangement, even though the cooking operations to be performed may have various different parameters, such as cooking time and temperature, the operations can be caused to advantageously, automatically finish at the same time.

SUMMARY OF THE INVENTION

The present invention is directed to a system used to program and coordinate the cooking operations for two or more ovens such that the cooking operations are completed at the same time, independent of particular setting variations. In accordance with a preferred embodiment of the invention, a single controller is utilized to program each of the ovens, with the controller incorporating an auto sequencing feature which causes the different cooking operations to be automatically performed, while terminating at the same time. Preferably, the system enables a second cooking operation to be programmed and initiated after a first cooking operation, while still providing for the auto sequencing of the cooking operation.

In accordance with the invention, a user need not calculate any delayed cooking operation or properly time the initiation of a second cooking operation in order to assure that the multiple cooking operations will finish at the same time. In accordance with another aspect of the invention, a cooling system is employed which enables one or more of the ovens to be refrigerated prior to initiating a programmed cooking operation. In any event, additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF THE PREFERRED EMBODIMENTS

Figure 1:
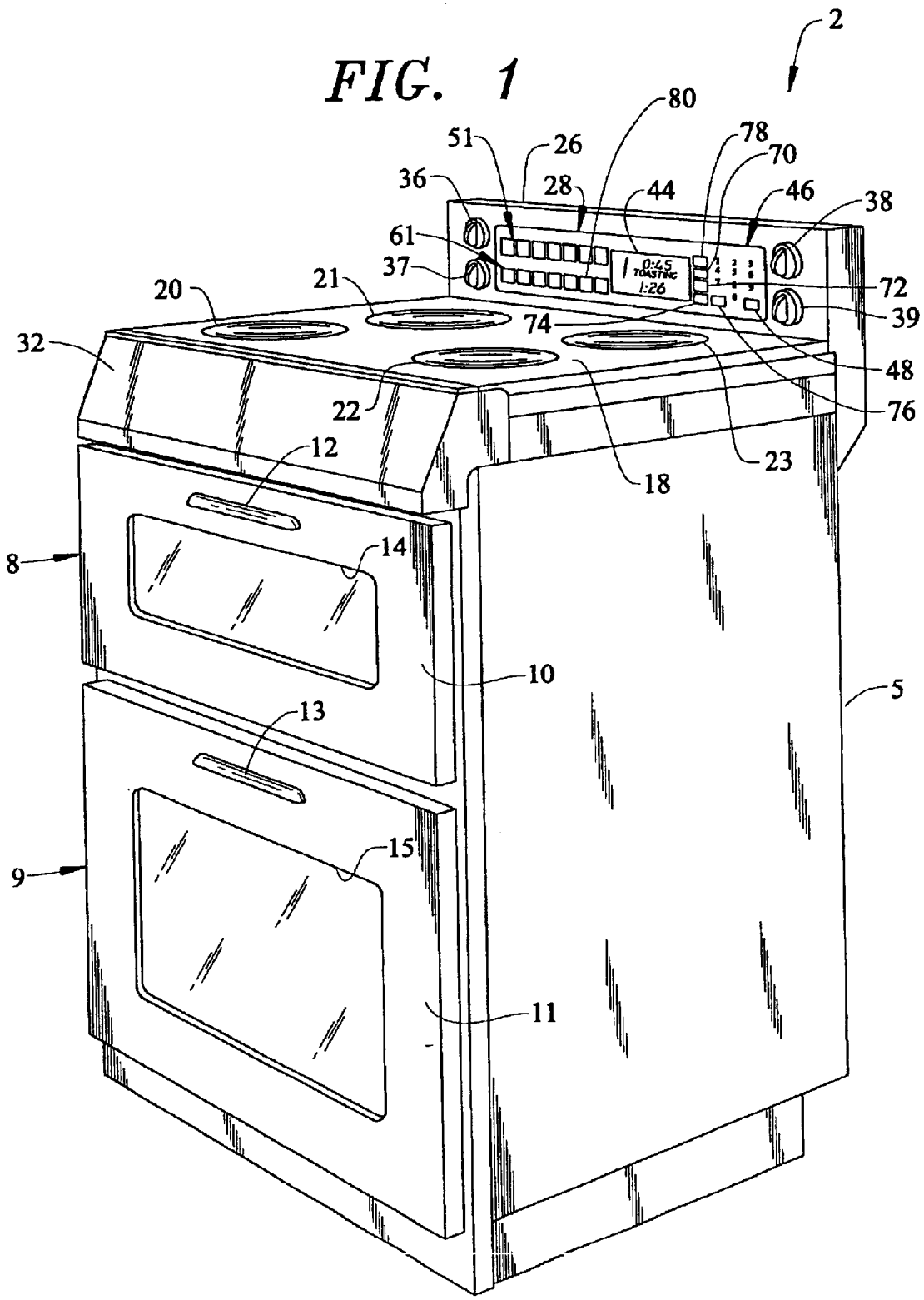
FIG. 1 is a perspective view of a slide-in double oven range incorporating the automatic cook sequencing system of the present invention.

With initial reference to FIG. 1, the invention is illustrated for use in connection with an electric range generally indicated at 2. In the embodiment shown, electric range 2 includes a cabinet 5 within which is arranged a first or upper oven 8 and a second or lower oven 9. Upper and lower ovens 8 and 9 have associated doors 10 and 11 which are respectively provided with handles 12 and 13 that can be used to pivot doors 10 and 11 in order to access respective cooking chambers or cavities of ovens 8 and 9. For the sake of completeness, this figure illustrates doors 10 and 11 with respective viewing windows 14 and 15.

Cabinet 5 is also provided with an associated range top 18 which supports various spaced surface heating elements 20–23 in a manner known in the art. At an upper rear portion, cabinet 5 includes an upstanding portion 26 which is provided with a control panel 28. At this point, it should be realized that the arrangement and location of control panel 28 could vary in accordance with the present invention. For example, control panel 28 could be located along an upper face panel 32 of cabinet 5. In any event, upstanding portion 26 includes a plurality of knobs 36–39 for use in selectively activating and deactivating surface heating elements 20–23 respectively. Control panel 28 is preferably arranged between knobs 36–39 and is shown to include a substantially central display 44, such as an LED, LCD or VFD display unit. Furthermore, control panel 28 is provided with a number pad generally indicated at 46 that has an associated button 48 for use in setting a clock arranged either within display 44 or in another portion of control panel 28.

As also known in the art and shown in this figure, control panel 28 of range 2 includes a first row of control buttons generally indicated at 51 which are generally used to establish an operational mode for upper oven 8. Although not separately labeled, first row 51 preferably includes cancel, bake, broil, cleaning mode, toasting, warming mode and light control members shown in the form of buttons. In a generally similar manner, a second row of control buttons 61 are provided for lower oven 9. In the most preferred form of the invention, second row 61 includes cancel, bake, broil, cleaning mode, convection mode and light control members, preferably in the form of individual buttons. In the most preferred form of the invention, the user is able to program the operation of at least upper and lower ovens 8 and 9 through the use of the first and second rows of buttons 51 and 61, along with numeric pad 46, timer buttons 70 and 72, cook time and stop time buttons 74 and 76, and an auto set button 78. Since this basic programming arrangement is known in the art as exemplified by U.S. Pat. No. 6,255,630 which is incorporated herein by reference, and not considered part of the present invention, it will not be described further here in detail. Instead, with reference to this first embodiment, the inclusion of sequencing button 80, shown arranged between the convection mode and light buttons in row 61 for exemplary purposes, is of concern with respect to the present invention. In general, sequencing button 80 can be used to cause programmed cooking operations for ovens 8 and 9 to automatically terminate at the same time, regardless of whether different cooking levels, times and/or modes are selected. In any event, additional details of the preferred sequencing control will be presented below after discussing the embodiment of FIG. 2.

Figure 2:
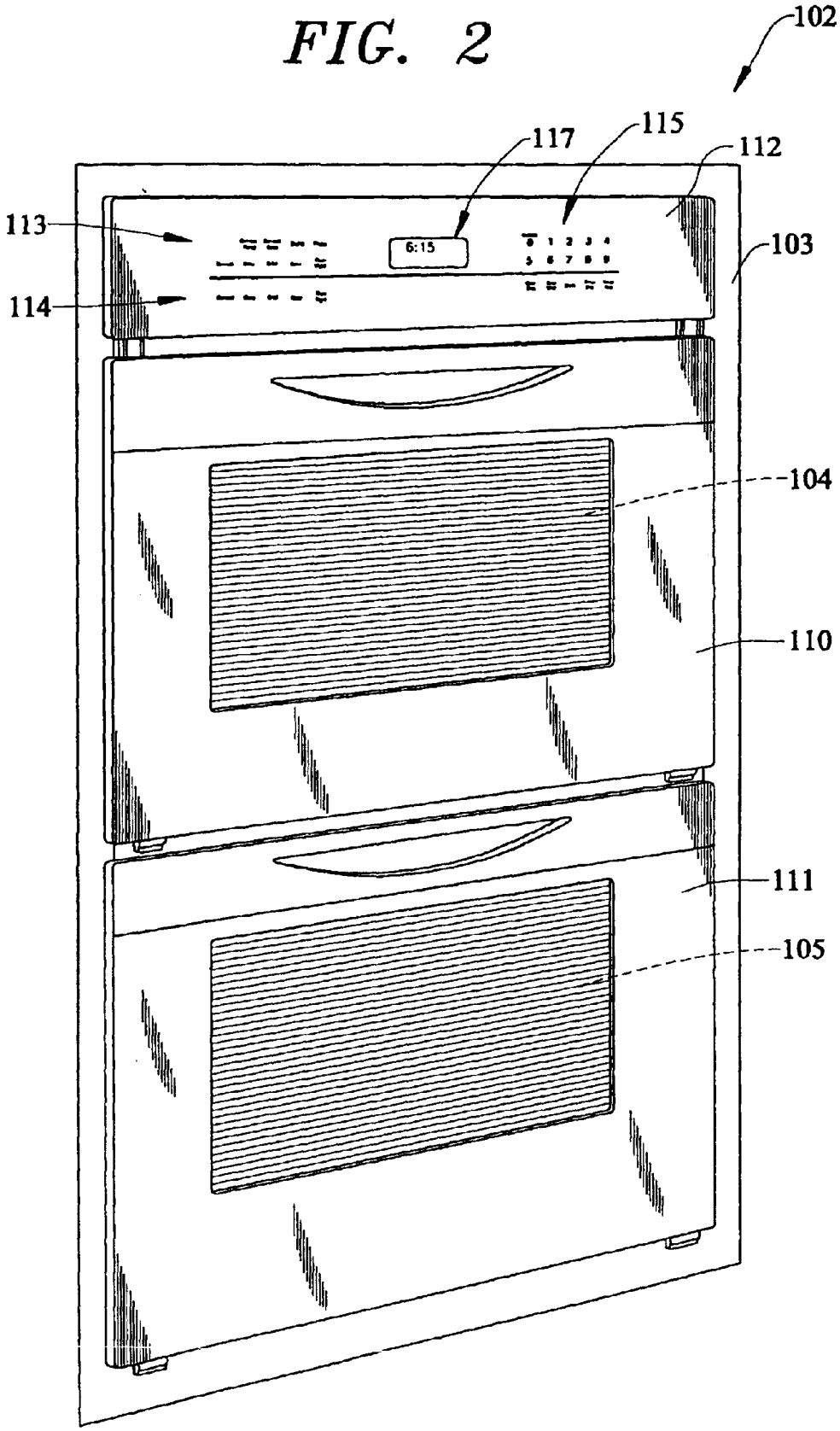
FIG. 2 is a perspective view of a double wall oven incorporating the automatic cook sequencing system of the invention.

FIG. 2 shows the invention in connection with a cooking appliance 102 depicted as a wall oven. In the embodiment shown, cooking appliance 102 constitutes a dual oven wall unit which includes a structural frame 103 supporting an upper cooking cavity 104 and a lower cooking cavity 105. According to the present invention, respective door assemblies 110 and 111 are provided to selectively provide access to upper and lower cooking cavities 104 and 105. Cooking appliance 102 is shown to incorporate an upper control panel 112. In the embodiment shown, control panel 112 includes first and second rows of oven control buttons 113 and 114 for programming, in combination with a numeric pad 115 and a display 117, particular cooking operations for oven cavities 104 and 105 respectively.

Again the general programming and operation of cooking appliance 102 to perform distinct cooking operations in oven cavities 104 and 105 is known in the art and does not form part of the present invention. Instead, like the embodiment of FIG. 1, different cooking operations can be established for oven cavities 104 and 105 through upper control panel 112. What is important to note in connection with this embodiment is that the present invention can be applied to dual wall ovens. In fact, the invention is applicable to any dual oven arrangement wherein the controls for the ovens are linked. At this point, it should be realized that the embodiment of FIG. 2 has not been described as including a button directly corresponding to sequencing button 80 of the first embodiment. Instead, in this embodiment, certain predetermined control elements on panel 112 are utilized to initiate a desired sequencing operation. For instance, depressing two or more buttons within numeric pad 115 simultaneously would initiate the sequencing operation as will not be discussed with reference to FIGS. 3 and 4.

Figure 3:
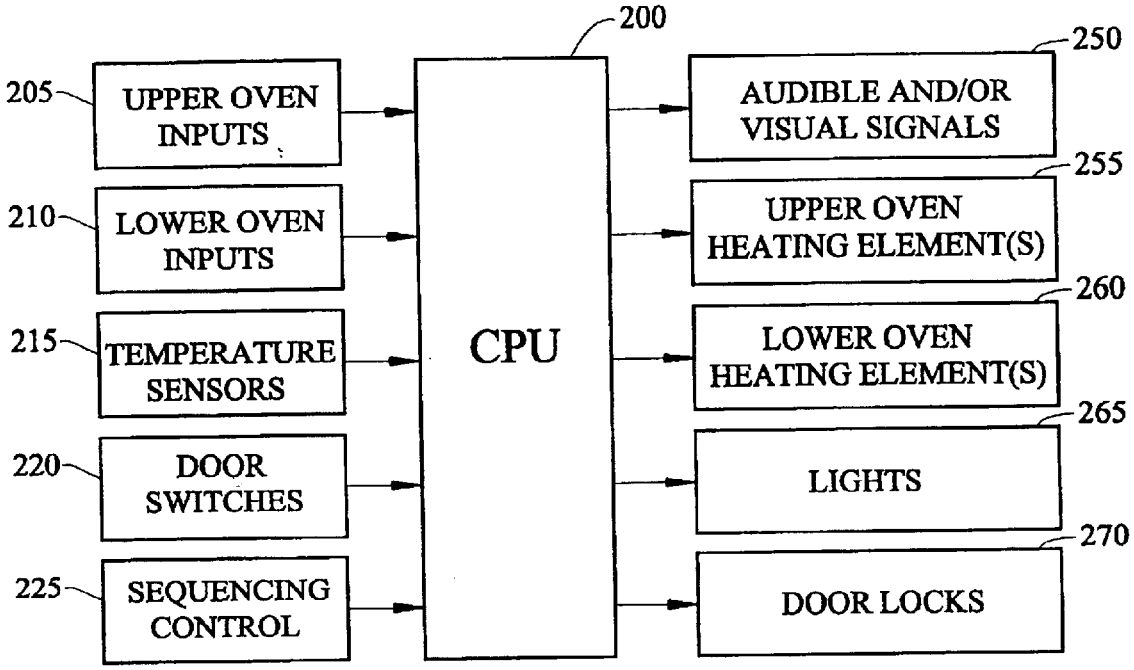
FIG. 3 is a block diagram illustrating the control system of the invention.

In accordance with the invention, the sequencing operation can be performed in various fashions. In general, the control of cooking operations performed in oven cavities 8 and 9, or 104 and 105, are regulated by a common controller, such as CPU 200 as shown in FIG. 3. CPU 200 receives cooking operation control inputs for upper oven cavities 8, 104 as indicated at 205, with upper oven inputs 205 collectively including selection from row 51, 113, numeric pad 46, 115, cook time and temperature settings. In a similar manner, CPU 200 receives cooking operation control inputs for lower oven cavities 9, 105 as generically indicated at 210. Additional control signals can also be received in a manner known in the art, such as temperature and door position signals as indicated at 215 and 220 respectively. Again, operating a dual oven in this general manner is known in the art. However, in accordance with the invention, CPU 200 is also linked to a sequencing control 225, which preferably constitutes either sequencing control button 80 or a predetermined simultaneous or sequential operation of a plurality of control elements. CPU 200 can also output various operational parameters, such as audible and/or visual signals at 250, upper oven heating element(s) 255, lower oven heating element(s) 260, lights 265 within the oven cavities 8, 9 or 104, 105, and door locks 270.

More specifically, in accordance with the invention, the cooking mode, temperature and/or time settings for upper and lower oven cavities 8, 9 or 104, 105 can vary from each other by inputs at 205 and 210. If sequencing control 225 is not activated, separate and distinct cooking operations will simply be performed, whether immediately or on a delay basic depending on the particular operator programming. However, if sequencing control 225 is activated, CPU 200 will automatically function to sequence the two cooking operations to finish at the same time. In this sense, the operator need not calculate one or more specific delay times in order to assure that two different food items will be completed simultaneously.

Figure 4:
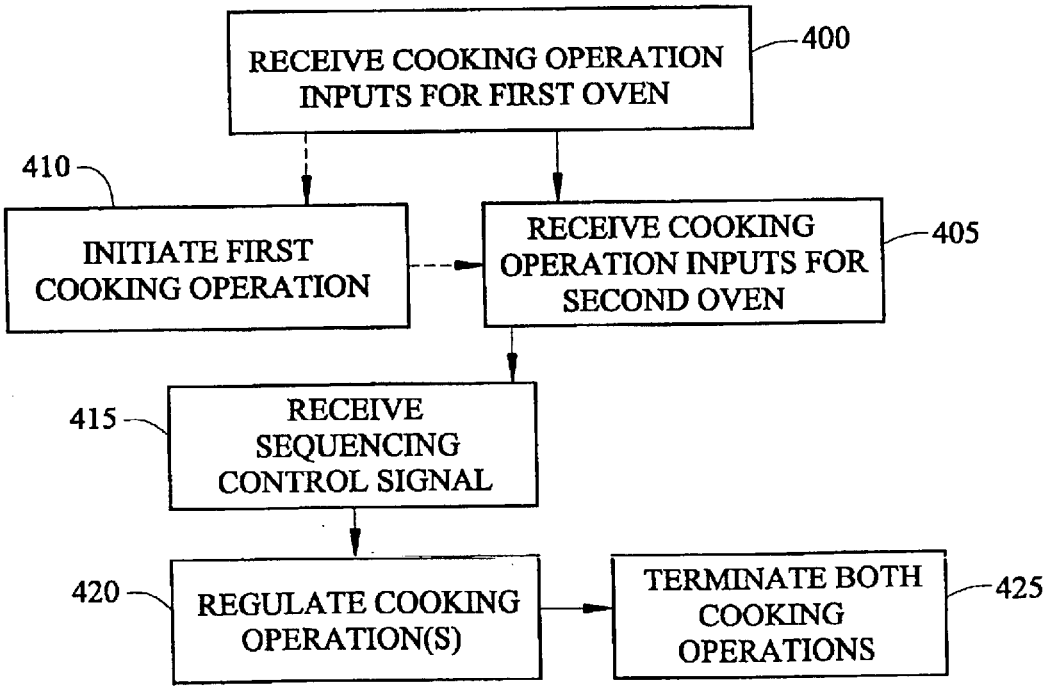
FIG. 4 is a flow diagram showing a control sequence in accordance with the invention.

FIG. 4 will now be reference to present a particular cooking example. In initial step 400, a user establishes a first desired cooking operation in a first one of the dual oven cavities, such as a casserole to be cooked at 350° F. for sixty minutes. In accordance with the invention, a user can next establish a second desired cooking operation for the second one of the dual oven cavities in step 405, such as arranging biscuits for cooking at 475° F. for twelve minutes. It is also possible in accordance with the invention to enable the first cooking operation to be initiated at 410 prior to proceeding to step 405. In either case, if an automatic sequencing control signal is received at 415, the first and second cooking operations will be automatically sequenced to finish at the same time. In the particular example provided, the start of the second cooking operation would be automatically delayed by CPU 200 for approximately forty-eight minutes and, more specifically, enough time to allow for the twelve minute cook time and, preferably, an ample warm-up period.

When employing the present invention, the user need not calculate any delay period, which can be particularly problematic if an initial delayed cooking operation is established for the first oven cavity or if the first cooking operation is already underway. If a second cooking operation is to be sequenced with a first cooking operation which is already underway and the time remaining on the first cooking operation is less than that established for the second cooking operation, CPU 200 will preferably provide an audible and/or visual non-available sequence signal to the user at 250. In any event, if the cooking operations are successively programmed, CPU 200 will control the respective ovens to turn on the oven with the longest cook time first, then automatically sequence the other oven at an appropriate time to allow both ovens to complete their cooking functions at precisely the same time.

Figure 5:
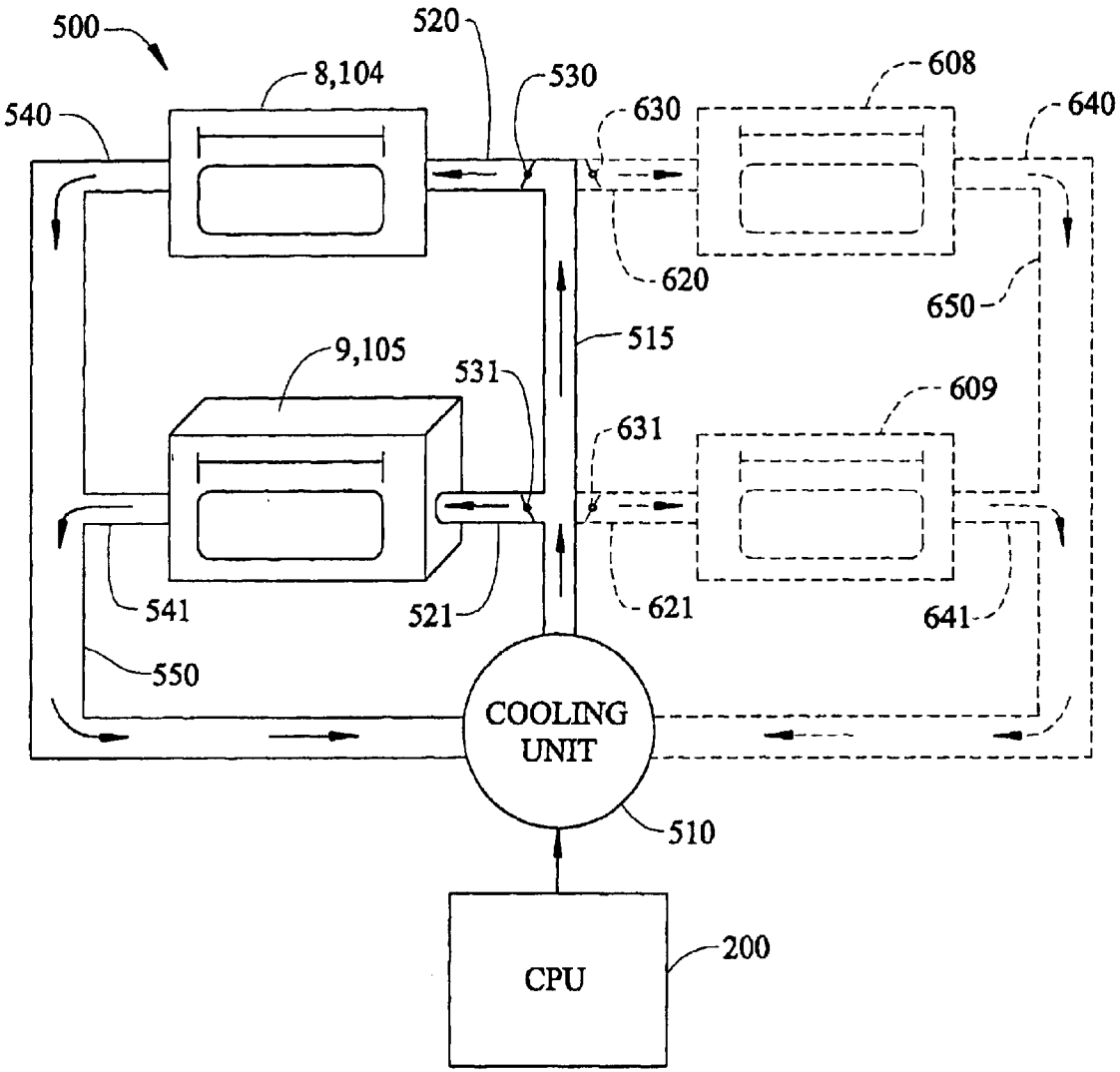
FIG. 5 is a schematic diagram illustrating the incorporation of a cooling arrangement in the overall sequencing system of the invention.

In furtherance of simultaneously completing multiple cooking operations in two or more ovens in accordance with the present invention, it is also desired to employ a refrigeration system with one or more of the ovens in order to selectively enable food items to be held at below room temperature prior to initiating the cooking operation. For instance, when a delayed cooking operation is desired as discussed above, it may not be healthy to perform the operation if one or more of the food items in upper and/or lower oven cavities 8, 9 or 104, 105 need to be maintained at below ambient temperature prior to cooking. Therefore, in accordance with an aspect of the invention illustrated in FIG. 5, a refrigerating system 500 is employed to maintain reduced temperatures within one or more of the oven cavities 8, 9 or 104, 105. This can be performed by inputting a desired, reduced temperature to be established and maintained, or simply pressing a single "refrigeration" control button (not shown) for directly establishing a refrigerating operation in the desired oven cavity 8, 9, 104, 105 which will enable CPU 200 to simply initiate the refrigeration operation prior to the corresponding cooking operation.

As shown, refrigerating system 500 includes a cooling unit 510 constructed in a manner known in the art, such as including a compressor, condenser, evaporator and expansion valve circuit or a thermoelectric device. In any case, cooling unit 510 is adapted to direct a flow of cooling air into a supply conduit or manifold 515. Supply conduit 515 has stemming therefrom a pair of parallel arranged inlet conduits 520 and 521 which lead to oven cavities 8 and 9 or 104 and 105 respectively. Preferably disposed in inlet conduits 520 and 521 are respective damper units 530 and 531 which are used to regulate the desired flow of cooling air into each of the respective oven cavities 8 and 9 or 104 and 105.

Leading from oven cavities 8 and 9 or 104 and 105 are outlet conduits 540 and 541. Outlet conduits 540 and 541 open to a return conduit or manifold 550 which, in turn, leads back to cooling unit 510. When employing refrigerating system 500, upper oven inputs 205 and/or lower oven inputs 210 includes additional control elements (not separately shown) used to program at least desired cooling temperatures which will be established until the further established cooking operation is initiated. Therefore, CPU 200 would further control the operation of cooling unit 510 and one or more of damper units 530 and 531. This figure also illustrates that cooling unit 510 can actually be used with even further oven cavities, such as oven cavities 608 and 609, through additional inlet conduits 620 and 621, damper units 630 and 631, outlet conduits 640 and 641, and return conduit 650. In any case, food items placed in any of the oven cavities can be maintained refrigerated prior to being cooked in accordance with the invention, with the cooking operations still be sequenced.

Although described with reference to preferred embodiments of the invention, it should be readily understood that various changes and/or modifications can be made to the invention without departing from the spirit thereof. For instance, as indicated above, it should be readily apparent that the automatic cook time sequencing system of the present invention, with or without the refrigeration system, can be incorporated into a variety of different types of cooking appliances having multiple ovens. To this end, it should be recognized that the ovens in accordance with the present invention can also vary and may include radiant, convection, microwave, combinations thereof, and the like. In addition, the ovens can be heated through various energy sources, including electricity or gas. Therefore, in general, the invention is only intended to be limited by the scope of the following claims.

I claim:

1. A cooking appliance comprising:

a first oven cavity;

a second oven cavity;

a plurality of heating elements for establishing elevated temperatures in the first and second oven cavities;

a refrigerating system for establishing a reduced temperature in at least one of the first and second oven cavities;

means for inputting control parameters to establish the reduced temperature in the at least one of the first and second oven cavities, along with first and second cooking operations for the first and second oven cavities respectively, wherein the control parameters includes first and second distinct time parameters; and means for initially establishing the reduced temperature in the at least one of the first and second oven cavities and, subsequently, automatically sequencing the first and second cooking operations such that the first and second cooking operations in the first and second oven cavities are completed simultaneously.

2. The cooking appliance according to claim 1, wherein the control parameters include distinct temperature parameters for the first and second oven cavities.

3. The cooking appliance according to claim 1, wherein said means for inputting control parameters comprises directly selecting a refrigeration operation.

4. The cooking appliance according to claim 3, wherein the refrigerating system includes a cooling unit arranged in fluid communication with each of the first and second oven cavities.

5. The cooking appliance according to claim 4, wherein the refrigerating system further includes a common supply duct leading from the cooling unit to each of the first and second oven cavities.

6. The cooking appliance according to claim 5, wherein the refrigerating system further includes first and second damper units interposed between the supply duct and the first and second oven cavities respectively.

7. The cooking appliance according to claim 5, wherein the refrigerating system further includes a common return duct leading from each of the first and second oven cavities to the cooling unit.

8. The cooking appliance according to claim 1, wherein the cooking appliance comprises a dual oven wall unit.

9. The cooking appliance according to claim 1, wherein the cooking appliance comprises a dual oven range.

10. In a cooking appliance system including first and second oven cavities, a cooking operation control system comprising:

means for establishing a first cooking operation, including a first time parameter, for the first oven cavity;

means for refrigerating the first oven cavity prior to initiating the first cooking operation;

means for establishing a second cooking operation, including a second time parameter, in the second oven cavity; and means for automatically sequencing the first and second cooking operations such that the first and second cooking operations in the first and second oven cavities are completed simultaneously.

11. The cooking operation control system according to claim 10, wherein the first and second cooking operations include distinct temperature parameters for the first and second oven cavities.

12. The cooking operation control system according to claim 10, wherein said means for refrigerating the first oven cavity prior to initiating the first cooking operation enables direct selecting of a refrigeration operation.

13. The cooking operation control system according to claim 10, wherein said means for refrigerating the first oven cavity includes a cooling unit arranged in fluid communication with each of the first and second oven cavities.

14. The cooking operation control system according to claim 13, wherein said means for refrigerating the first oven cavity further includes a common supply duct leading from the cooling unit to each of the first and second oven cavities.

15. The cooking operation control system according to claim 14, wherein said means for refrigerating the first oven cavity further includes first and second damper units interposed between the supply duct and the first and second oven cavities respectively.

16. The cooking operation control system according to claim 14, wherein said means for refrigerating the first oven cavity further includes a common return duct leading from each of the first and second oven cavities to the cooling unit.

17. The cooking operation control system according to claim 10, wherein the cooking appliance system constitutes a dual oven wall unit.

18. The cooking operation control system according to claim 10, wherein the cooking appliance system constitutes a dual oven range.

19. A method of operating a cooking appliance having first and second oven cavities comprising:

setting a first set of cooking parameters to establish a first cooking operation for the first oven cavity;

setting a second set of cooking parameters to establish a second cooking operation for the second oven cavity;

performing a refrigerating operation in at least one of the first and second oven cavities prior to initiating either of the first and second cooking operations;

sequencing the first and second cooking operations such that the first and second cooking operations in the first and second oven cavities are completed simultaneously.

20. The method of claim 19, further comprising: regulating a damper unit arranged in a conduit leading from a cooling unit of a refrigerating system of the cooking appliance to the at least one of the first and second oven cavities to control a refrigeration temperature in the at least one of the first and second oven cavities.

* * * * *